US005208589A

United States Patent [19]

Reynolds

[11] Patent Number: 5,208,589

[45] Date of Patent: May 4, 1993

[54] MAGNETICALLY CONTROLLED INDICIA DISPLAY DEVICE

[76] Inventor: Eugene E. Reynolds, 1145 Pacific Beach Dr., Apt. 407, San Diego, Calif. 92109

[21] Appl. No.: 554,794

[22] Filed: Jul. 23, 1990

[51] Int. Cl.[5] ..... G09G 3/16

[52] U.S. Cl. ..... 340/764; 340/783; 40/449

[58] Field of Search ..... 40/449, 450, 451, 473, 40/474, 466; 340/764, 783

[56] References Cited

U.S. PATENT DOCUMENTS

| | | | |
|---|---|---|---|
| 2,371,511 | 3/1945 | Faus | 340/764 |
| 4,161,832 | 7/1979 | Bergamini | 40/466 |
| 4,163,332 | 8/1979 | Salam | 340/764 |
| 4,295,127 | 10/1981 | Sautter et al. | 340/764 |
| 4,744,163 | 5/1988 | Browne et al. | 40/449 |
| 4,914,427 | 4/1990 | Trunk | 340/764 |

*Primary Examiner*—Ulysses Weldon
*Assistant Examiner*—Matthew Luu
*Attorney, Agent, or Firm*—Armand G. Guibert

[57] ABSTRACT

A panel display having one or more magnetically responsive changeable indicia and magnetic controls for changing the display of each indicia, desired ones of the indicia being selected and stabilized by rotation or translation of control magnets. The indicia elements are pivotally supported and contain elongated magnets magnetized across their thickness rather than longitudinally, the elongated magnets being centered within the indicia elements along the pivotal axis. Each indicia element is paired with an adjacent movable control magnet which occupies at least two positions for purposes of exercising control of the display. The display is particularly intended for presenting pin fall information and cumulative frame-by-frame scores in the game of bowling.

7 Claims, 8 Drawing Sheets

FIG. 15
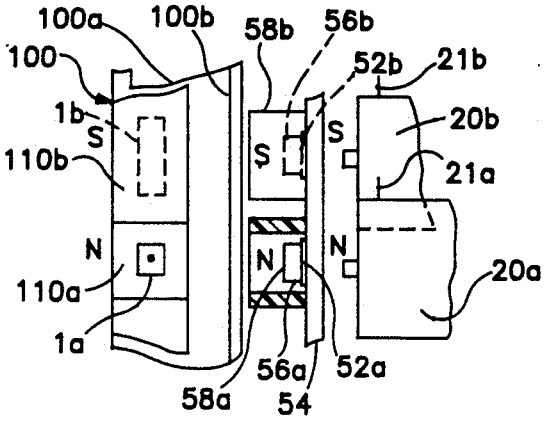
FIG. 16
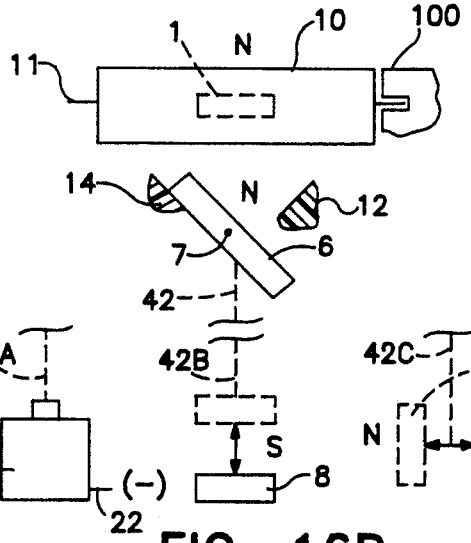
FIG. 16A
FIG. 16C
FIG. 16B

MAGNETICALLY CONTROLLED INDICIA DISPLAY DEVICE

FIELD OF THE INVENTION

The present invention relates to panel displays and magnetic controls for changing the indicia of such displays. Panel displays may be used for a plurality of purposes; however, preferred embodiments of the changeable display according to the invention are applied to bowling scoring devices. My U.S. Pat. No. 3,738,652—now U.S. Pat. No. 30,471 granted Dec. 29, 1978—shows how pin fall sensors generate electrical signals for translation to a display device. The disclosure of U.S. Pat. No. 30,471 is hereby incorporated by reference.

BACKGROUND

Previous displays and those presently used in Automatic Bowling Scorers are projection devices and/or cathode ray tubes. Projection devices require considerable current and become less legible in daylight hours. Cathode ray tubes become bulkier, heavier more expensive and less legible as size is increased. This has led to use of two separate CRT displays (at each lane). The first is a small, complete game display showing names and frame-by-frame scoring as the game progresses and is provided on a console in the players' space in back of the bowler's approach area. According to ABC scoring rules, this display is the required score record. It is, however, too small to be read more than a few feet away and is located such that the current bowler cannot see it from the approach area. The bowlers themselves are therefore provided with a second CRT display, mounted for viewing from the approach area by being suspended from the ceiling in the region of the foul line. The second CRT displays are necessarily large and heavy and correspondingly costly to install, yet are still not legible more than a few feet beyond the bowles' approach area.

To compensate, one presently used system displays only three current player frames at a time in the overhead unit of each lane. It is still not legible to spectators and causes confusion in determining which bowler is playing and who is up on which lane next during team play.

SUMMARY OF THE INVENTION

The present invention concerns a thin flat panel display apparatus which is light in weight yet presents large indicia legible at appreciable distance, and that uses electrical energy only to effect the change of indicia after which the display is fixed and consumption of energy is nil. An advantage of this arrangement is that the display is of such light weight as to eliminate the previous need of heavy auxiliary supports for cathode ray tubes used in bowling score devices.

Also an advantage of the invention is that rotary movement of the elements is noiseless and without distracting drive actions, no controls being visible (all are behind a front panel).

Another advantage is that the indicia display, being of large size, is legible at greater distances and angles than is possible with cathode ray tubes.

A main object of the invention is to provide an improved changeable display device which is light in weight, low in consumption of electrical energy, and which—when used in bowling score apparatus—provides greater visibility by spectators as well as the bowlers.

Another object is to use a single control device for setting particular ones of a plurality of display devices to respective display positions.

Still another object is to provide a magnetic toggle for holding a display device in a set position.

Yet another object is to provide magnets in a novel array for changing the display of indicia.

Other advantages and objects of the invention will become evident by reading the following description of the invention along with inspection of the accompanying drawing.

BRIEF DESCRIPTION OF THE DRAWING

FIG. 15 shows a preferred embodiment for display of the single-digit pin fall information in a bowling score display.

FIGS. 16(A–C) shows the use of two control magnets, one of which may be an electromagnet, to effect a toggle action on a display unit.

FIG. 17A shows a reversed polarity current supply to the circuit of FIG. 17.

DESCRIPTION OF PREFERRED EMBODIMENTS

Figure 19:
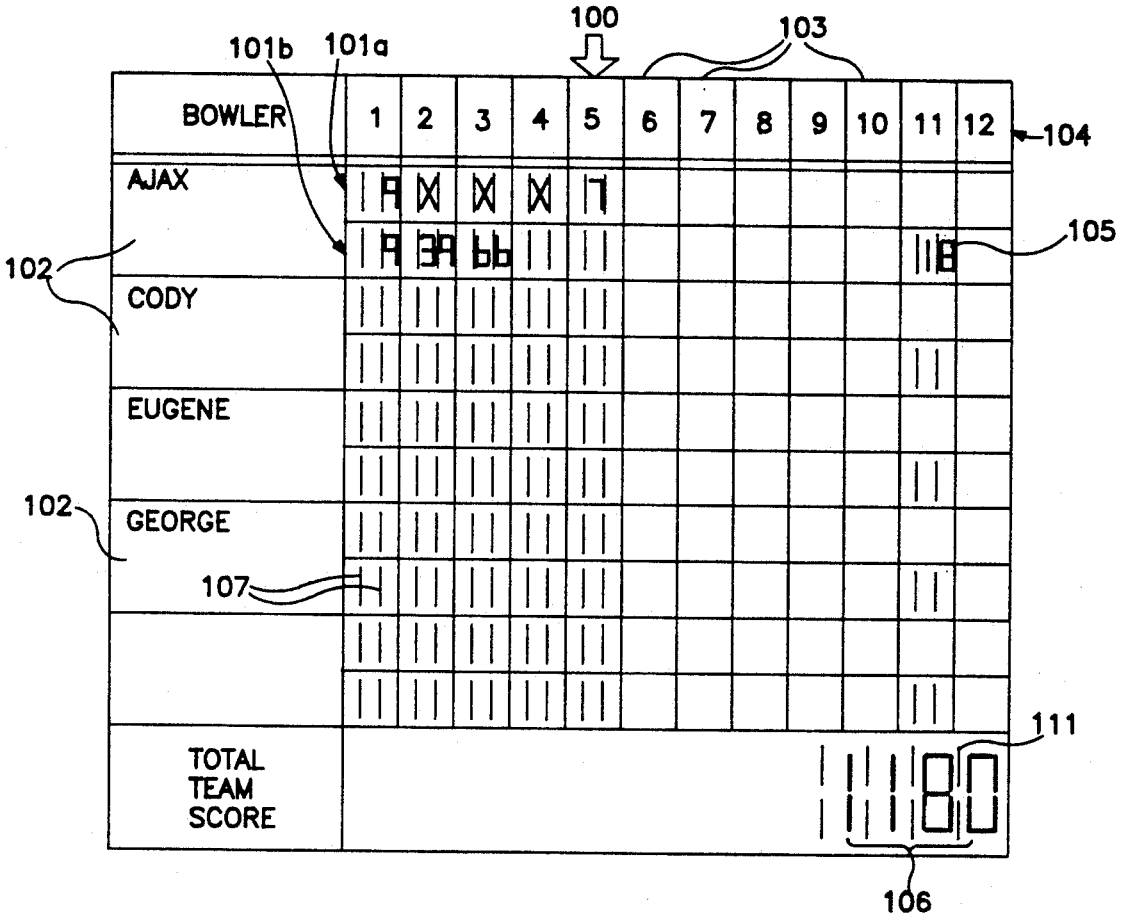
FIG. 19 shows a typical bowling score display panel using indicia elements controlled as in any of FIGS. 1–18.

A preferred embodiment of the invention is shown in FIG. 19. A bowling score panel is generally indicated at 100 and comprises a plurality of pairs 101 of scoring lines for each bowler; each line-pair 101*a,b* includes a space 102 for the bowler's name and a series of Frames 103 (twelve in number, each separately identified on the top line 104 and the last two being needed only if all pins were downed in the tenth frame) for showing in successive frames, the accumulated number of points (101*b*) and the current number of downed bowling pins (101*a*) for each player as the game progresses. Because the eleventh and twelfth frames of line 101*b* are not used for cumulative scores, handicap data and adjusted scores 105 may be displayed there for particular players. In the case of team play, an area 106 shows (preferably on a larger scale) total number of points gained by the entire team. Usually, the scores for players on each of two teams are shown on separate Scoring Panels 100 in adjoining lanes, though the players from each team bowl successive frames alternately on each lane.

According to the present invention, a plurality of indicia Display Devices 108 (see FIG. 17, described in greater detail subsequently) may be provided, both for showing the names of the bowlers, and also for showing the cumulative score and pin-down counts for each bowler in successive ones of the Frames 103. These frames must generally accommodate three output spaces (indicated by dashed lines 107) for symbol displays and first and second ball information (the "pin down counts" as termed hereinafter) and up to three digits for cumulative scores up to a possible total of 300 for each bowler, i.e.—a maximum of 1500 points total (four output spaces, indicated by dashed lines 111 in area 106) for a team having five members.

Alphanumeric displays may be used, though other forms of displays may be used as necessary to accommodate display of pictorial or geometric figures, for example.

Alphanumeric multi-bar displays are well known in the art and, according to the present invention, each individual bar is comprised of a magnetically controlled display device 1 (FIG. 1) including—in one simple form—a pair of magnets, the first being pivotally mounted in the Bowling Score Panel 100 (not shown in FIG. 1) and controlled by the second magnet in response to a signal thereto representing presence or absence of a pin fall count, the display device having a color on one side thereof contrasting with the background color of the bowling Score Panel 100. Thus, at least seven Display Devices 1 are employed for each number or letter to be displayed, as explained subsequently.

Figure 1:
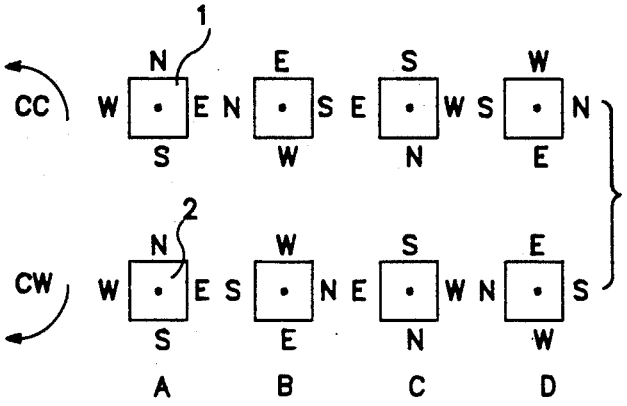
FIG. 1 is an end view showing a pair of magnets, one of which is rotated in controlled, reversible steps to cause counterrotation of the other magnet.

A typical Display Magnet 1 is shown in end view in FIG. 1 and in side view in FIG. 3. Magnet 1 is a rectangular parallelepiped (approximately ½ inch long by 3/16ths inch wide by 3/16 inch thick) magnetized across the shortest dimension (i.e. perpendicular to the longitudinal axis) and made, for example, of bonded ferrite material well known in the art for resisting demagnetization "permanently" (e.g., various rigid polymer or flexible rubber bonded barium ferrites available from 3M Company of St. Paul, Minn.). Magnet 1 is preferably embedded in a non-magnetic Matrix Material (or "carrier") 10*c*, as shown in FIG. 4, and since Magnet 1 and Carrier 10*c* form an integral unit, the two are shown in the drawing as a unitary member or "Display Unit" 10.

In practice, embedment of each small magnet 1 is achieved by molding it in a four-sided bar-like Unit 10 made of the abovementioned matrix material 10*c* (any suitable plastic, say). Unit 10, as it will be designated hereinafter for convenience, may be rotated to expose a desired side having a color, texture, or design contrasting with a background (Panel 100) so as to form a readily discernible part of a letter or indicia. Ordinarily, a neutral side blending with the background will be exposed initially. The Units 10 are rotated relative to the background by providing movable control magnets or by changing the direction of an electrical current in a control coil. For the latter purpose, the coil may be positioned relative to a Unit 10 (and its magnet) so that current in one direction will not disturb the normal position of Unit 10, but current in the opposite direction will flip Unit 10 by 180° to display the contrasting side. It will also be shown that proper positioning of the movable magnet or the coil may control a 90° rotation of Unit 10 (Magnet 1) and if a square cross section of the carrier is provided, selection of three different colors for the letters or numerals is possible by combined magnetic orientation through electrical and mechanical (physical) positioning.

FIG. 1 shows in cross section the orientation of two magnets 1 and 2 magnetized as shown North and South establish the flux path of each magnet in known fashion. East and West designations are relative reference designations and do not control, but are necessary to show relative orientation. Assuming that a display magnet 1 is free to rotate and an operating magnet 2 is rotated clockwise (cw) from position A to position B, then magnet 1 will rotate counterclockwise (ccw) to position B. Similarly, continued movement of Magnet 2 in the same sense to position C will result in Magnet 1 being positioned as shown at C and further similar movement of Magnet 2 to position D will result in relative positioning of Magnet 1 as shown. It should be noted that when one magnet is free to rotate while the other is controlled, any desired rotation of the free magnet can be achieved because the North and South sides always attract while two North or two South sides facing each other always repel one another, as is known. Sides with East and West designations may, however, end up facing or opposite or can appear to act like they repel. The latter designations are made simply to keep track of relative movement and to provide predictive results of primary and secondary movement. The four sides of Magnet 1 may be of different colors and when desired to expose a particular color on Magnet 1, for example, one must know and take into consideration whether that color is clockwise or counterclockwise (i.e., East or West) from North or South and rotate Control Magnet 2 in that direction.

Figure 2:
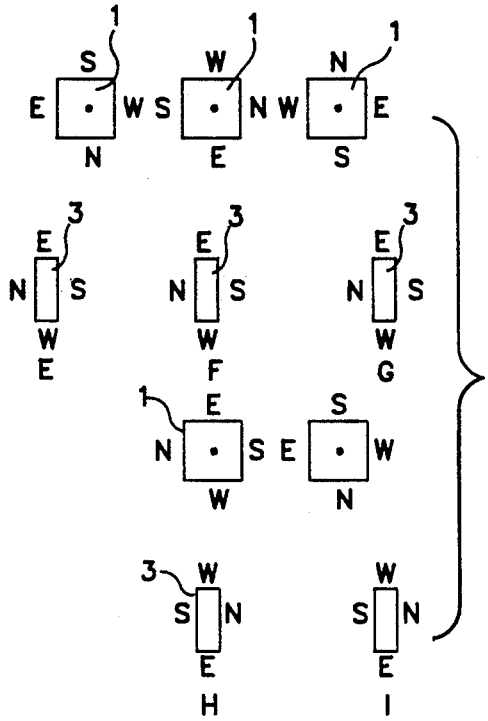
FIG. 2 is an end view showing a first magnet rotated under control of a second magnet which is moved laterally relative to the axis of the second magnet.

FIG. 2 shows, on the other hand, relative positions and resultant orientation of Magnet 1 when that magnet is again free to rotate and a Control Magnet 3 is moved laterally under Magnet 1. Positions E,F, and G show Control Magnet 3 with North-South orientation remaining same (North facing left as in FIG. 1D) while positions H and I have Control Magnet 3 oriented with South facing left. A comparison of relative position F with G, and G with I, shows that the North-South faces of Display Magnet 1 are reversed in position when Control Magnet 3 is reversed in North-South relationship. These are predictable relationships and result from free flux through both magnets. For example (FIG. 2E), considering flux flow within each magnet as South to North, and outside each magnet as North to South (as is conventional), one would have a clockwise direction of flux path at top of Magnet 3 and at left (E) side of free (i.e., rotationally unconstrained) Magnet 1. The combined flow would also be a large clockwise pattern with the combined easiest path being from North of Magnet 1 to South of Magnet 3, through Magnet 3 and out Magnet 3 to South of Magnet 1 and through Magnet 1 to the North face of this last. The external flux path of both magnets is attained as the easiest path for the combined flux paths by the free rotation of Magnet 1 and determined b the position of Control Magnet 3 relative to the North and South faces of Magnet 1. This is the explanation of observed behavior of two magnets within each other's influence when only one of them is free to rotate. The shortest outside path between North of Control Magnet 3 and South of rotationally free Magnet 1 prevails (vice versa, depending on initial orientation of Magnet 3).

Figure 3A:
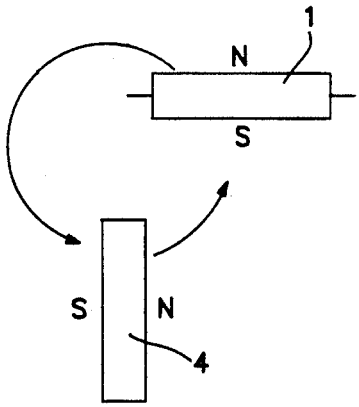
FIGS. 3A, 3B are side views showing how a first magnet may be rotated under control of a second magnet to either of two angular positions which are 180° apart, the axis of the second magnet being at 90° relative to the first magnet, and movement of the second magnet being from one end of the first magnet to the other end of that magnet.
Figure 3B:
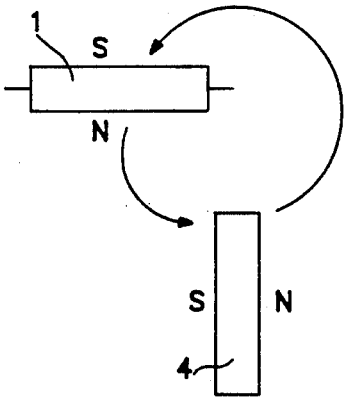

Referring to FIG. 3A, Magnet 1 is free to rotate and may be selectively stabilized in each of four different rotated positions by the mounting (e.g., inclusion of a light spring-driven detent) or by use of a small piece of "soft" metal in the area of influence. The stabilization force must be light and not prevent rotation. Magnet 1 is elongate, square in cross-section and magnetized such that one lateral face is poled North with the opposite face poled South, a different reaction resulting at each end in response to present of another magnet (4) aligned at 90° relative to the axis of Magnet 1. This follows because, North face being up, the flux path is counterclockwise at the left end and clockwise at the right end. Control Magnet 4 is shown as oriented vertically in FIG. 3A and Display Magnet 1 is mounted with its axis horizontal. Display Magnet 1 will orient itself to position shown (North on top) when Control Magnet 4 is located at left of Magnet 1 and has its South pole facing left. If Magnet 4 is positioned at right (FIG. 3B) Magnet 1 will rotate on its horizontal pivot so that the North face is down and the South face is up. The rotational movement is therefore by 180°. This particular characteristic is very advantageously used to effect a 180° rotation of the display magnet by physical (mechanical) movement of Magnet 4. This is very useful in applications where only blend or contrast with the background color of panel 100 (e.g. black against white) is needed for the display. To present indicia on each of the four faces of Magnet 1, Magnet 4 may be rotated 90° about a vertical axis through Magnet 4, either clockwise or counter-clockwise (depending on proximity to the right or left end of Magnet 1) and as evident from FIGS. 1A–1D.

Figure 4A:
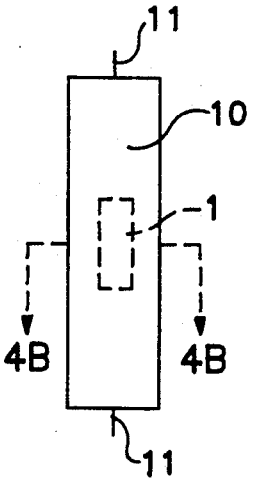
FIG. 4A is a side view of an indicia element with a magnet axially embedded therein.
Figure 4B:
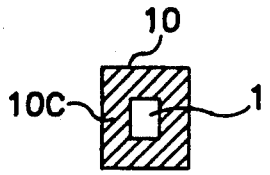
FIG. 4B is a cross-sectional axial view of the indicia element of FIG. 4A taken along the arrows 4B—4B of that figure.

FIGS. 4A and 4B show a preferred form of an indicia Display Unit 10 having Magnet 1 embedded at center, in a vertical operating position and (in cross section) for horizontal disposition, respectively. Unit 10 is supported on Pivots 11 at each end.

Figure 5A:
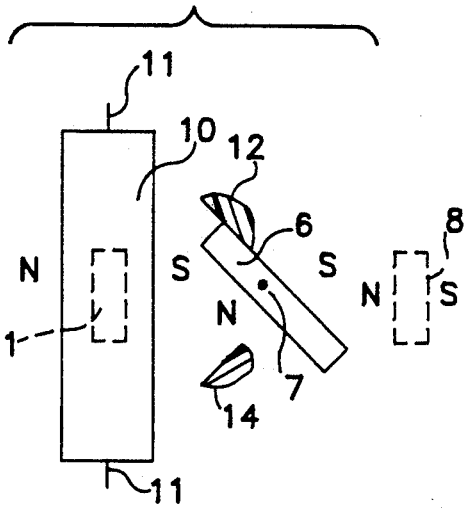
FIGS. 5A, 5B are side views of an indicia element as in FIG. 4, the indicia element being rotatable under control of an oscillatable magnet having its axis offset from the indicia element and mounted at 90° relative to the vertical axis of rotation of the indicia element. The position of the oscillatable magnet is determined, in turn, by the polarity of a setting magnet (shown by dashed lines).
Figure 5B:
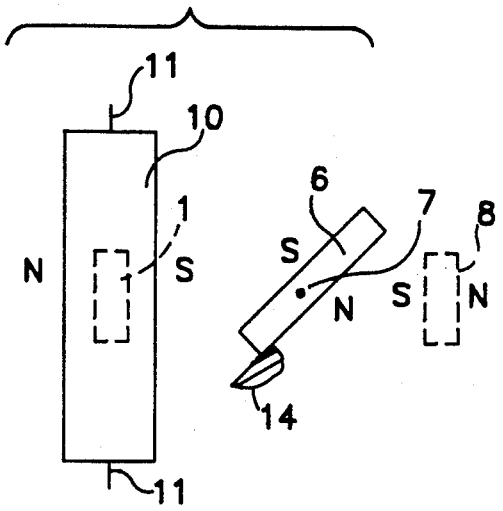
Figure 6:
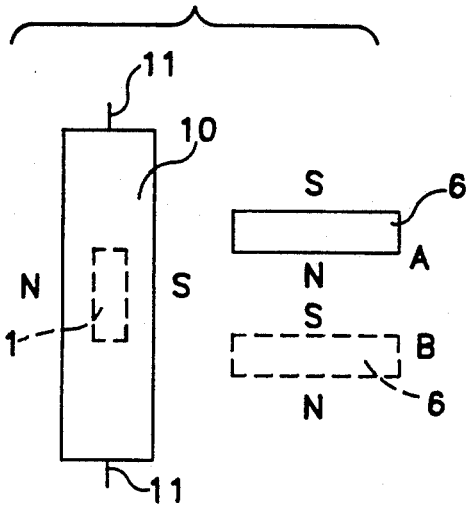
FIG. 6 shows a rotatable indicia element with an embedded magnet, the indicia element being under control of a magnet mounted for end-to-end movement relative to the embedded magnet along the axis of rotation of the indicia element.
Figure 7A:
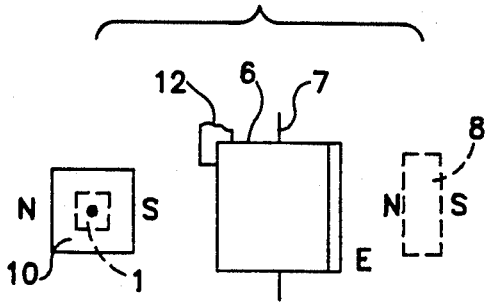
FIGS. 7A, 7B shows an indicia element rotatable about a horizontal central axis (differing therefore, from the vertical arrangement in FIGS. 5A, 5B) under control of an oscillatable magnet in which the axis of oscillation of the magnet is vertical.

The structures depicted in FIGS. 5A, 6, and 7A show control of the angular position of Magnet 1 about its axis through the influence of a Magnet 6. In FIGS. 5 and 7, this is accomplished by rocking Magnet 6 about a Pin 7 from the position in A to the position in B (roughly 90°). Movement of Magnet 6 does not have to be pivotal, however, FIG. 6 showing straight up and down movement along the axis of Unit 10 as sufficient to produce the same results as in FIGS. 5A, 5B. In each case, the change in position of Magnet 6 is from one end of Magnet 1 to the other end (just as in FIG. 3, except that here Unit 10 is mounted vertically relative to a horizontal Magnet 6 and Magnet 1 is embedded in Unit 10.

FIG. 5A shows a vertical Display Unit 10 as in FIG. 4A, embedded Magnet 1 at its center and North surface of Magnet 1 facing left. A Magnet 6 is pivoted on a Pin 7 opposite the midpoint of Magnet 1 for control of this last. The upper end of Magnet 1 is effectively positioned by the proximity of North face (N) of Magnet 6 relative to the South face (S) of Magnet 1. Contrastingly, in FIG. 5B Magnet 1 is exposed to the South face (S) of Magnet 6, Display Unit 10 being rotated 180° upon a roughly 90° counterclockwise rocking of Magnet 6 about Pin 7.

Figure 7B:
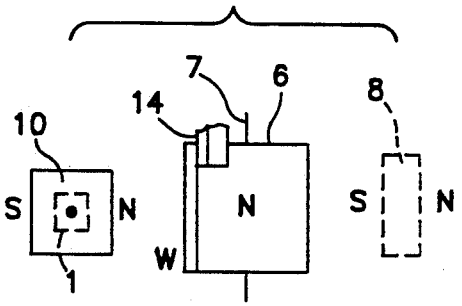
Figure 17:
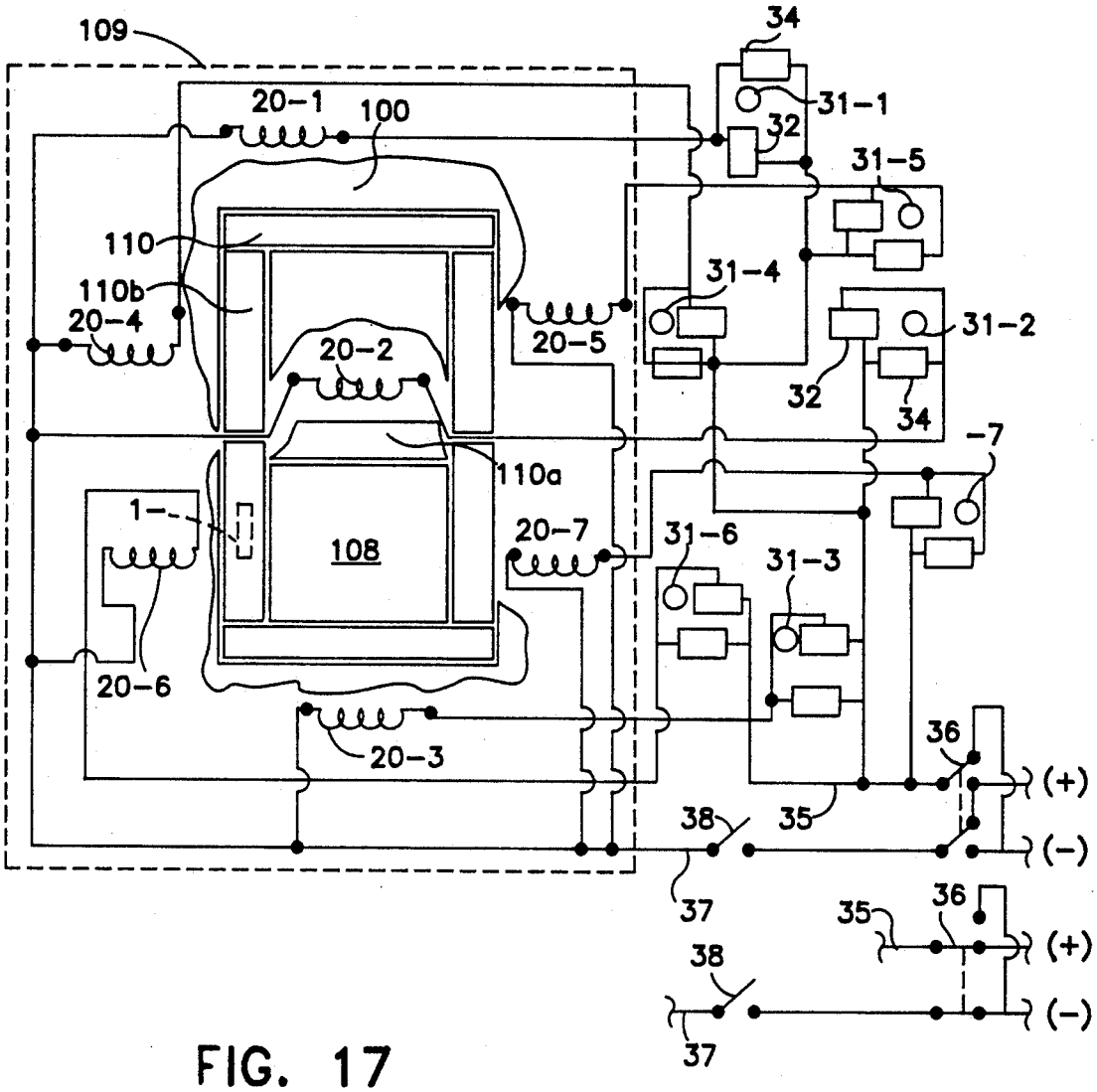
FIG. 17 is a schematic diagram of a circuit for achieving setting magnet control over the indicia elements of a numeric display

FIG. 7, on the other hand, shows movement by Magnet 6 about a vertical arrangement of Pin 7 for control of Unit 10 when pivotal support for Unit 10 is horizontal (e.g. for positioning the horizontal segments of the seven-member Display 108 of FIG. 17). If Magnet 1 is mounted horizontally relative to Magnet 6, the North-South positions change as shown in FIGS. 7A, 7B, the same 90° movement of Magnet 6 about Pin 7 effecting the same 180° rotation of Magnet 1 about Pivots 11 with either horizontal or vertical mounting. This is advantageous for ease of control magnet movement. Note also that—as discussed in some detail subsequently—the right-angular relation between the pivotal axes of Magnets 1 and 6 results beneficially in a toggle-like interaction between the magnets.

In sum, Magnet 6 orientation may be accomplished by direct physical (mechanical) movement of that magnet or it may be controlled by presence of yet another Magnet 8 having a particular polarity, as shown in dashed lines in FIGS. 5A, 5B and 7A, 7B. Thus Magnet 1 may position Unit 10 responsive to direct physical (mechanical) means or by magnetic response (which can also result from use of electrical means, as will be seen). Magnet 8 must be able to influence Magnet 6 throughout its resultant movement and this will depend on location of Pin 7. For example, if Pin 7 is moved away from the center of Magnet 6 toward the far end thereof, the required degree of rocking of Magnet 6 to encompass the full length of Magnet 1 becomes smaller (and vice versa, of course). In general, the free flow of magnetic flux controls the physical size required and necessary positioning of the magnetic elements.

As stated earlier, the magnetic elements could be controlled either by electrical pulses or by physical movement of magnets through means which may be described as robotic. Such physical movement may be controlled remotely by computerized techniques or straight electrical circuitry. For example, FIG. 1 shows Magnet 1 rotated by stepwise revolving of Magnet 2, the latter magnet being stepped by any means convenient to the operation (e.g., a known step motor with ancillary gears, if needed) because the object is to locate Magnet 1 at a desired angular position about its axis. FIG. 2 shows similar rotation of Magnet 1 but solely by lateral movement of Magnet 3, no rotation of this last being involved. In other words, magnets may be positioned by physical movement or by electrical means and magnetic polarity. Magnetic polarity may be controlled by physical movement of a magnet or by electrical means (DC) and change in electrical polarity. Various examples of the latter are shown in FIGS. 8–10.

Figure 8:
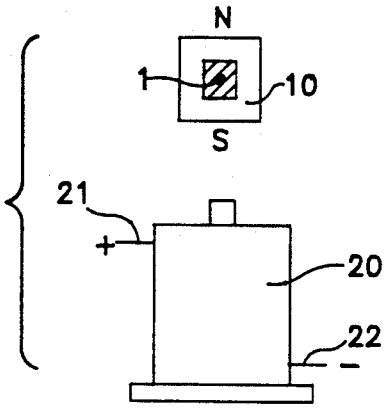
FIGS. 8, 9A and 9B show how momentary reversal of polarity of an electromagnet may reverse the display of a rotatable indicia element, the changed display being held thereafter.

FIG. 8 shows a Coil 20 positioned relative to Magnet 1 so that North is up with respect to Coil 20 when normal current flows therein. Assuming that this orientation is attained by applying a plus (positive electrical polarity) direct current to Coil 20 at least 21 and minus electrical polarity to lead 22, then reversing the current by operation of a known switch, say, to apply minus (negative) electrical polarity to lead 21 and plus (positive) to lead 22 would reverse North and South magnetic orientation of Magnet 1 about its central axis. This would be a direct electrical orientation of Unit 10. A Setting Magnet 8 (FIGS. 5 and 7) may be used to control Intermediate Magnet 6, as described, Magnet 8 being magnetically oriented by a Coil 20 in the same manner, if desired. Note that, though not shown herein, stops similar to 12, 14 likewise may be used to limit arcuate or linear movement of Magnet 8.

Figure 9A:
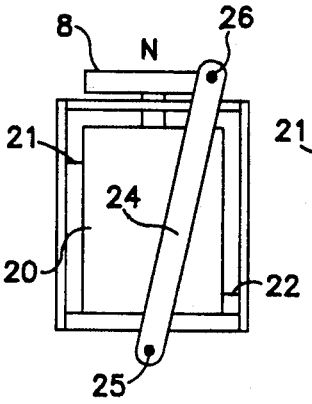
Figure 9B:
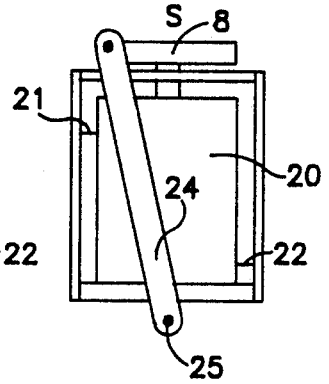

FIGS. 9A and 9B show that a single Magnet 8 may be used for display, being flipped 180° about a Pivot 26 from North to South display position by appropriate changes in direction of current flow in an adjacent Coil 20, a Supporting Lever 24 pivoted about a Pin 25 (affixed to the base of Coil 20, say) acting as a toggle to hold Magnet 8 in either position of display.

Figure 10A:
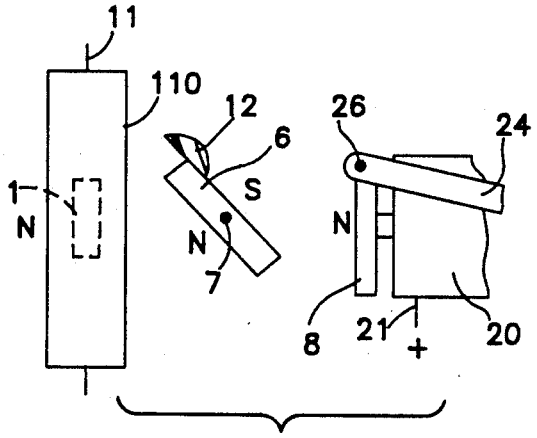
FIGS. 10A and 10B show a variant operation from that shown in FIGS. 8, 9A and 9B.

Referring next to FIG. 10A, it will be noted that Magnet 1 has been used within a carrier (similar to 10c) which is pivotally mounted and intended to serve as a Segment 110 of a letter or a number to be displayed (as described subsequently with respect to FIG. 17). At least one face (N, say) of Segment 110 is of neutral color (same color as background Panel 100—FIGS. 17,19) and the opposite face of a contrasting color so as to be present or absent in accordance with the part of the letter or a number to be displayed. An Intermediate or "Toggling" Magnet 6 serves not only to position Magnet 1, but also to maintain Magnet 1 in the position attained. Magnets 1 and 6 tend to hold their positions once attained because interaction of the magnetic flux from Magnet 6 with that of Magnet 1 produces attracting forces promoting stable positioning of the two magnets relative to one another, Stops 12, 14 preventing further rotation of Magnet 6 toward parallel orientation. The relationship is reciprocal: any small force tending to modify the position of Segment 110 (Magnet 1) is countered by the attracting force from Magnet 6, and vice versa. Magnet 6 may, of course, be moved from the position against Stop 12 (FIG. 10A) to the position against Stop 14 (FIG. 10B) by applying sufficient force through the mechanical means, electromagnet means (direction of DC current in a Coil 20), or magnetic means described previously in connection with FIGS. 5A to 9B. A magnet of the above-described bonded ferrite type roughly ½"×½" square (or ½" in diameter, if round) and ¼" thick is suitable for satisfactory operation as Magnet 6.

The toggle-like interaction mentioned above is an inherent self-detenting action and—for purposes of my invention—it is intended that the magnets will normally be used in pairs for control of each Segment 110 by a Setting Magnet 8, except when space or other considerations dictate otherwise and another form of detent must be used.

Figure 10B:
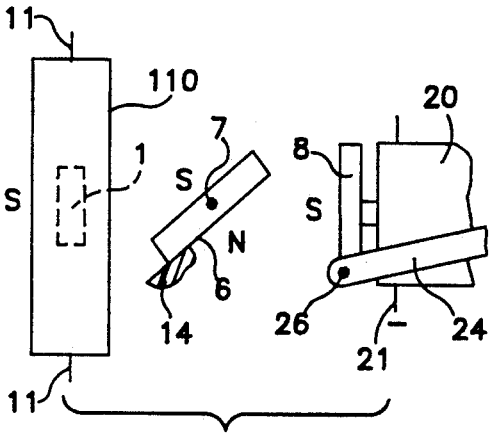

In FIGS. 10A and 10B a setting magnet also designated as Magnet 8 is provided. Again, this Setting Magnet 8 may be oriented or positioned by mechanical, electrical or magnetic means. Magnet 8 is shown as being oriented (magnetically) North or South by Coil 20 (as explained with regard to FIG. 9). FIGS. 10A and 10B show Magnet 1 (and Unit 10) positioned such that Toggling Magnet 6 and Setting Magnet 8 are effective in controlling orientation of Unit 10. In FIG. 10A, Magnet 8 is shown with North side at left (away from Coil 20). Toggling Magnet 6 is therefore in a first position about Pivot 7 with its South face presented toward the North face of Magnet 8 (toward Coil 20, therefore) and Magnet 1 is oriented with North side to the left. This orientation was attained, say, by applying a plus DC current to Lead 21 of Coil 20. If one then applies a minus DC current to Lead 21 of Coil 20, the poles of coil 20 will reverse ends, causing Magnet 8 to flip over as described above (see discussion of FIG. 9). Magnet 6 will then rock counterclockwise about Pin 7 to a new position against Stop 14 where its interaction with Magnet 1 will—in turn—cause Unit 10 to rock about Pivots 11 by 180° from its initial position—i.e., to the orientation of Unit 10 shown in FIG. 10B (South face now to the left).

The relationship of Magnets 1 and 6 may always be fixed in the manner shown in FIGS. 10A, 10B and still use the same positioning of Setting Magnet 8 to control Unit 10 in order to show neutral or contrast, whether such Unit 10 be pivoted vertically or horizontally on Display Panel 100 as part of a number or letter.

Figure 11A:
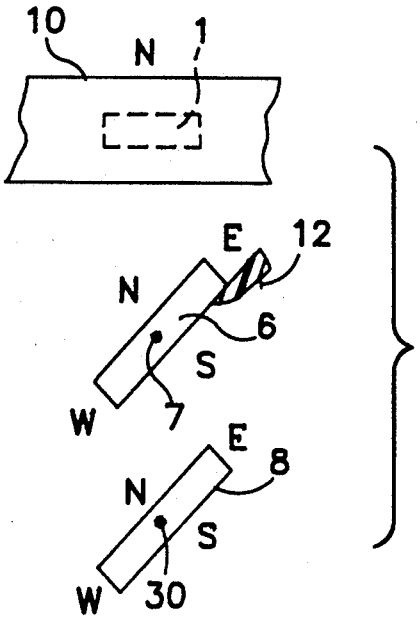
FIGS. 11A and 11B show a second variant in mounting magnets and indicia elements, an intermediate magnet being positioned by a pivotally rocked setting magnet, the pivots being in parallel.
Figure 11B:
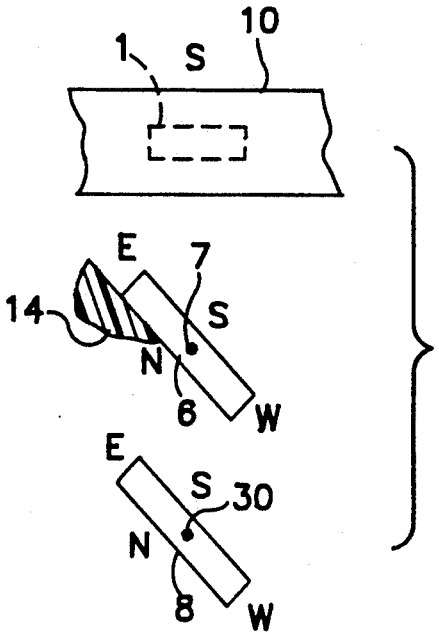

FIGS. 11A and 11B show relative positioning in which Setting Magnet 8 is rocked from either position to attain the alternate position, the movement being counterclockwise or clockwise, respectively (as seen by the viewer), about a Pivot 30 which is parallel to Pin 7. These changes in orientation result in corresponding 90° rotation of Magnet 6 about Pin 7, thus selectively causing Unit 10 (Magnet 1) to face either North or South upward as shown.

Figure 12A:
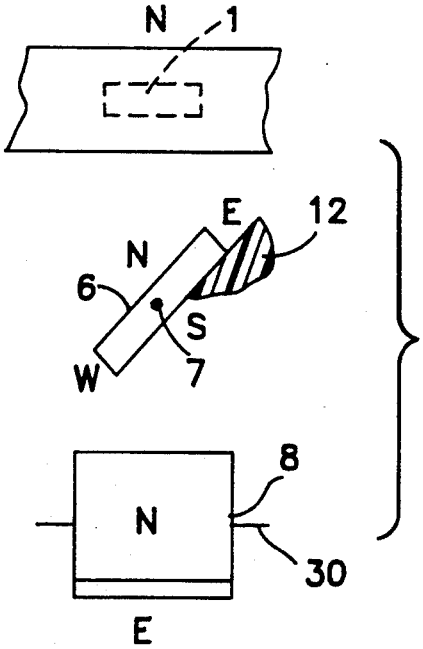
FIGS. 12A and 12B show an indicia element being reversed in its display by rocking of a setting magnet having its axis at 90° to the pivotal axis of an intermediate magnet as compared to the parallel pivot arrangement in FIGS. 11A, 11B.
Figure 12B:
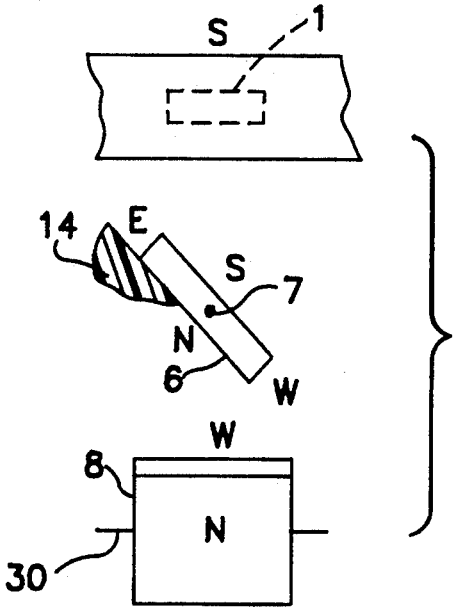
Figure 13A:
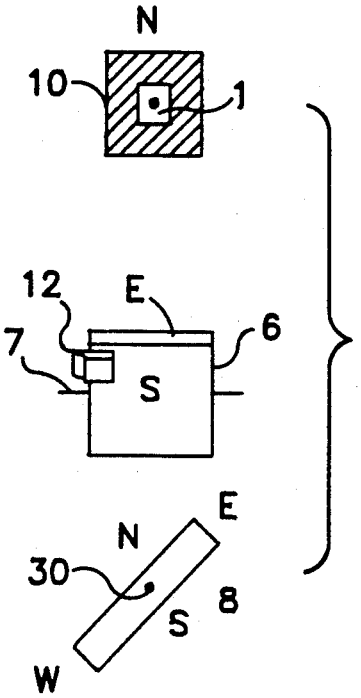
FIGS. 13A and 13B show side views of the respective magnet positions in FIGS. 12A, 12B.
Figure 13B:
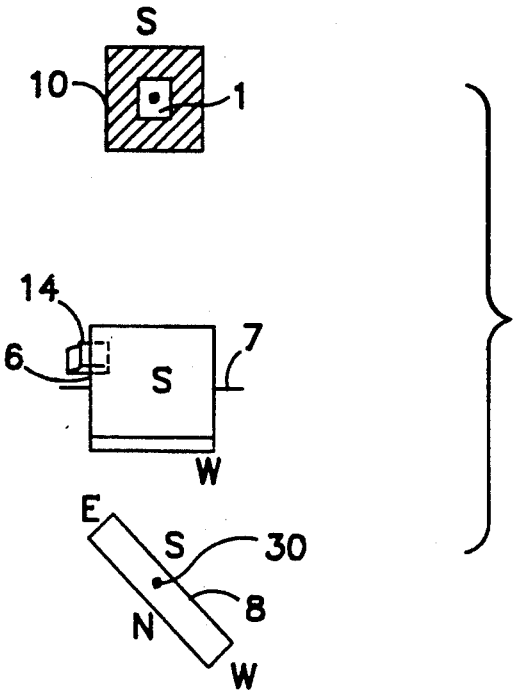

FIG. 12A shows that the same rocking of a Magnet 8 having its axis at 90° from that shown in FIGS. 11A–11B, can serve identically to change the display presented by Unit 10. As before, the same change in orientation of Unit 10 results from the same rocking of Magnet 8 whether Unit 10 is horizontal or vertical. FIGS. 13A and 13B show a view from the right along the axis of Pivot 30 (arranged as shown in FIG. 12) for more easily understanding the respective movements of Magnet 8 and Magnet 6 therein.

As evident from the above, respective electromagnetic Coils 20 may be used with each Display Unit 10 or a single Coil 20 may be moved past each of a series of Units 10 to form a digit with the very same results. Furthermore, a magnet (8) oriented by a coil (20) may be used to orient another magnet (6) to control a magnet (1) in a display unit (10) so that a series of digits may be displayed with provision of only enough coils (20) to set appropriate ones of a group (seven, say) of magnets (8) representing a desired digit and then positioning the group in one-to-one relation adjacent a similar arrangement (likewise seven) magnets (1,6) forming a Display Device 108 for effectively transferring the selected digit to the Display Device 108. Note that once orientation of the Units 10 is established in a given device, that number could be transferred in another direction if desired by preventing the elements in that given device from rotating while allowing the elements in the other device freedom to rotate. This allows great flexibility in the system and assures that limited space or other considerations need not impair the ability to accomplish the desired results.

Reference has been made to the shielding of one magnet from an unwanted effect of stray flux from a magnet in another unit near it in the system. Every magnet in the system potentially can have such an unwanted reaction, depending on proximity and relative location of the magnets. Each segment used to form a letter or digit is located and set according to the seven-segment concept, though, so thus these factors are thus not arbitrary. One must therefore prevent such effects on otherwise properly oriented magnets. This may be accomplished by placement of so-called "soft metal" (high permeability, low retentivity) elements within the flux path of the affected magnet to divert (shunt) or enhance the flux of a particular-magnet (or magnets). As is known, "soft metal" characteristically provides an easy path for magnetically induced flux in either direction, but does not hold magnetism. Magnetization of a metal normally results from flux induced through that metal and the holding of that induced magnetization after removing the flux source. Soft metal loses magnetization as soon as the source is removed. This characteristic results in making the soft metal piece act as a magnet only as long as the source is present. The metal attracts a magnet toward it and tends to stabilize the magnet as oriented, without regard to direction of flux induced and this flux within the metal is easily reversed. The influence of soft metal pieces is a matter of placement of the pieces so that the desired dominance is attained and such dominance allows the enhancement or weakening of the effects as required by the physical location of the magnetic elements.

In particular, if the shunt is large (twice magnet area, say) as compared to a contacting—or closely adjacent—magnet, the result is a substantially permanent hold with no observable effect by proximity of an energized electromagnet of greater strength than the magnet, the number of coil turns in the electromagnet and the current applied being selectable variables, as is known. If a medium size shunt (area about equal to the magnet, just as depicted in FIG. 15, say) were substituted, it would maintain the orientation of a magnet in contact with it even in the presence of an adjacent electromagnet equal in strength to the magnet. Providing an electromagnet of greater magnetic strength would allow the magnet to be flipped over, renewed contact with the shunt reliably maintaining the changed orientation thereafter (until the electromagnet was provided with a pulse of reverse polarity, of course). If, on the other hand, an even smaller shunt (half the area of the magnet, say) were used, it would control but not prevent a flip-over change in orientation of the magnet caused by proximity of an electromagnet of equal strength. The desired relationship in magnetic strength and the area of the metal contacting or facing the magnet may therefore be coordinated for optimum results. Note that a plain Magnet 8 may be substituted for the electromagnet and operated by other means, as stated earlier.

Figure 14:
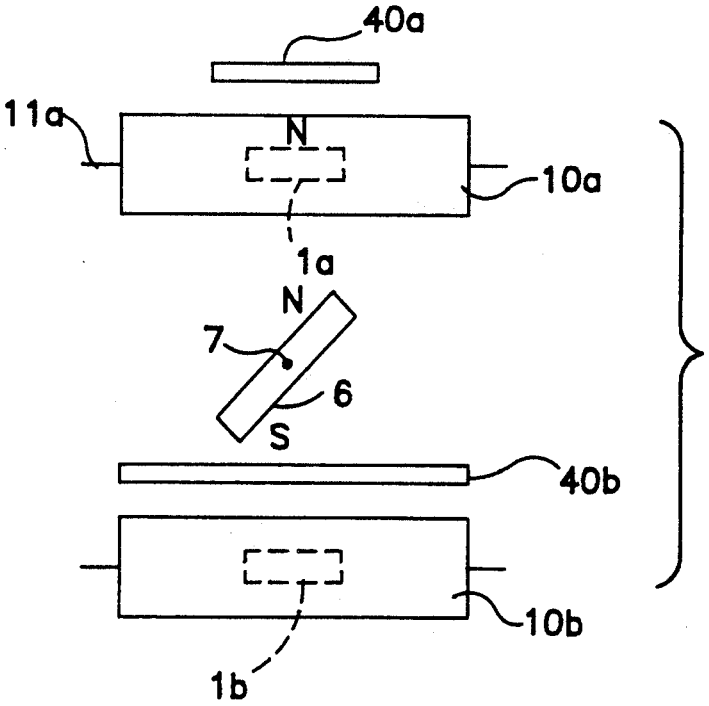
FIG. 14 shows use of soft metal flux path shunts to prevent interference between two adjacent magnets and/or to stabilize a given magnet in either of its positions.

FIG. 14 shows application of a "rule of thumb" relative placement of such soft metal flux path shunts. Two Indicia Units 10*a* and 10*b* are shown in close proximity such that interference would normally occur between Magnets 1*a* and 1*b*. Each Unit 10*a,b* is controlled for orientation about Pivots 11 by the respective embedded Magnets 1*a,b*. Magnet 1*a* is oriented by Magnet 6 to display the North face of Unit 10*a* upwardly. Unit 10*b* is parallel and located in a position to be influenced by Magnet 6. In the case shown, Unit 10*b* would normally be influenced by Magnet 6 to show North face upwardly but assume that it is desired to show South (opposite) face upwardly. To prevent the unwanted influence, one must place a soft metal Strip 40*b* between Magnet 6 and Magnet 1*b* of Unit 10*b*. Strip 40*b* will serve to shield Unit 10*b*, the magnitude of the shunt's effect depending on its size and location relative to Magnet 1*b*. The soft metal Strip 40*a* located as shown tends to stabilize Magnet 1*a* of Unit 10*a*, but will not prevent exercise of control when Magnet 6 is shifted in position. In fact, use of Strip 40*a* appears to enhance that control. The orientation and placement of the two soft metal Strips 40*a* and 40*b* provide a closed loop for the flux of Magnet 6 and Magnet 1*a* of Unit 10*a*. Strip 40*b* diverts the flux of Magnet 6, thus minimizing its influence on Magnet 1*b* of Unit 10*b*.

It has been suggested earlier that a set of two letters or numbers may be transferred in either direction by physically holding one set of magnets as oriented, the other set of magnets being left free so that each free unit orients or adjusts itself with the orientation of the adjacent stabilized unit. For such holding or stabilization, the magnets need not be in actual contact. Holding may be accomplished more easily, however, by soft metal placed to provide a flux path which will stabilize the desired magnets in their current orientation, yet allow movement of the respective magnets of the other set into corresponding orientation.

In changing orientation, Magnet 1 will go through a push-pull sequence if a pole of like polarity is brought close to its face of given polarity, inherent instability under this condition forcing Magnet 1 to rotate on its pivots if such are present. Note that even pivotless, Magnet 1 will rotate under influence of a second magnet having opposing polarity and controlled orientation. The controlled magnet may be physically prevented from changing orientation or that state may be magnetically produced. When controlled magnetically, the second magnet may be set to desired orientation and stabilized by association with a soft metal "shunt" (as termed herein). The "change" or "hold" character of the arrangement depends on the relative strength of the magnet and the thickness, frontal area and placement of the shunt, as mentioned earlier.

The utility of this association is illustrated schematically in FIG. 15 as a particularly simple embodiment of the invention. In that figure, the Magnets 56*a*, 56*b* shown are not the display magnets themselves, but are control magnets for setting of respective Display Units 110 (i.e., Magnets 1a,1b) and/or stabilization thereof. As will be described presently, Control Magnets 56a,b may be mounted on a non-magnetic backing (cardboard or plastic, for example) for purposes of transferring a number indicative of a pin fall count or part of a cumulative score. Seven Control Magnets (56a, 56b . . . g) are placed on the backing for setting a specific digit into the display. In FIG. 15, the non-magnetic backing is identified as 54, each metal stabilizer or "Shunt" as 52, the display setting/toggling Magnets 56, and a cylindrical member 58 shown in cross- section provides limits to lateral movement of each Magnet 56. Magnets 56 are magnetized North/South through the thickness of the material as before and may be round or rectangular in shape. Magnet shape is related to the desired effect, while the shape, thickness, etc. of the shunt and the magnet's strength are also interrelated and thus must be considered in producing the desired effect. Once determined, however, the relationship reliably produces the same effect in predictable fashion.

In FIG. 15, Units 110 (two being shown, one—110a—being horizontal, the other—110b—being vertical) are controlled by small toggling Magnets 56, each supported by a piece of the soft metal 52 affixed (as by known permanent adhesives) to a non-magnetic Backing 54 at an appropriate point in alignment with a respective Magnet 1 embedded in a rotatable Unit 110, as previously described. Metal squares about ½" on a side (or in diameter, if round) and about 1/32" thick have proven satisfactory as Shunts 52 in my experiments.

Indicia Units 110a, 110b may—for example—be the central and upper left segments of seven-segment Display 108 of FIG. 17. The view taken in FIG. 15 is leftward along the axis of central Segment 110a, Coil 20-2 partially obscuring Coil 20-5 behind it. The toggling Magnets 56a,b are preferably—though not necessarily—round and magnetized across the thickness as previously described. One or the other of their poles is normally in contact with the associated piece of soft metal 52 except in the short period of transition when a change of orientation is imposed, as next described.

Each of the Magnets 56 is located within a cylindrical, nonmagnetic Barrier 58—likewise affixed to Backing 54 by a suitable adhesive—which limits lateral motion of the respective Magnet 56, but is sufficiently large in its internal diameter and depth to permit a complete 180° reversal in orientation of that Magnet 56 within the confines of Barrier 58 when a pulse of electrical current is applied to Terminal 62 of the respective Coil 20 adjacent Shunt 52, non-magnetic Backing 54 intervening between the two. Restriction of Magnet 56 within Barrier 58 is assured by presence of a planar Back Portion 101b of Display Panel 100 at the other end of Barrier 58. If the pole created in Coil 20 (the current preferably being DC and of appropriate electrical polarity) adjacent Shunt 52 is identical to and substantially greater in strength than that in Shunt 52, then the ensuing repelling action between the poles brings about the desired change in orientation of Toggling Magnet 56. The result is that the previously exposed face (N, say, in the lower part of FIG. 15) of Magnet 56a now contacts Shunt 52a, whereas the previously contacting face (not marked in FIG. 15, but necessarily the South face in view of the assumption made for this discussion) is now exposed, causing a similar revolving of Unit 110a. Because of the presence of Shunts 52a, 52b; the position attained by Unit 110a is not only stabilized, but also the effect of unwanted interference from setting of an adjacent Unit 110b to an opposing magnetic polarity is reduced, though addition of a Shunt 40b—as explained previously in connection with FIG. 14—may still be necessary in some instances.

Primary stabilization is accomplished through the use of a pair of magnets interacting with one another in the toggle-like fashion described for maintenance of an established position. Stabilization through use of soft metal is a secondary approach usually intended more for small adjustments where exact magnet orientation is not achieved due to stray flux interference emanating from neighboring magnets. FIG. 16 further illustrates use of two magnets as a combined unit for the two-position toggle action. The Magnets 1 and 6 are pivoted at 11 and 7, respectively, with the pivotal axes at 90° from one another. Movement of Magnet 1 is 180° around its Pivots 11 when Magnet 6 rocks about 90° on Pin 7. In a manner similar to that explained earlier, Magnet 6 may be moved clockwise to orient Magnet 1 South upward or moved counterclockwise to orient the latter North upward (position as in FIG. 16). As described previously, control of desired orientation may be through a Coil 20 at the centerline 42/42A as shown at A in FIG. 16 or by use of a Magnet 8, as shown at B and C in that figure. As seen, movement of Magnet 8 may be up and down or laterally with respect to Magnet 6. If Magnet 8 is oriented horizontally (as at B) and moved upwardly along centerline 42/42B, Magnet 6 will flip to a position dictated by its current orientation, Magnet 6 not being affected—of course—if already properly oriented. Note that Magnet 8 must be pre-oriented to the necessary control position depending on which pole of Magnet 6 is adjacent to Magnet 1 when Magnet 6 is positioned against a particular one of the Stops 12,14 (compare polarization of Magnet 6 in FIG. 16 with the reversed polarization in FIGS. 13A and 13B, for example).

If, however, Magnet 8 is vertically oriented with respect to Magnet 6 (as at C in FIG. 16), left and right lateral movement about the centerline 42/42C will flip Magnets 1 and 6 to the opposite orientation. Positioning Magnet 8 at right of line 42/42C through pivot 7 of Magnet 6 (solid outline in C) orients Magnet 1 with North face upward(position shown in FIG. 16—i.e., face W of Magnet 6 adjacent Stop 14). Return of Magnet 8 to the left of line 42/42C (dashed outline in C) flips face W of Magnet 6 against Stop 12, orienting Magnet 1 with South face upward (as previously described in connection with FIGS. 3 and 6). Orientation of Magnet 1 is always predictable in terms of the orientation or position of Setting Magnet 8. Control of Magnet 8 may be effected by mechanical movement thereof or by passage of electric current through an adjacent Coil 20, etc., as previously described (e.g., FIGS. 10A, 10B).

Figure 18:
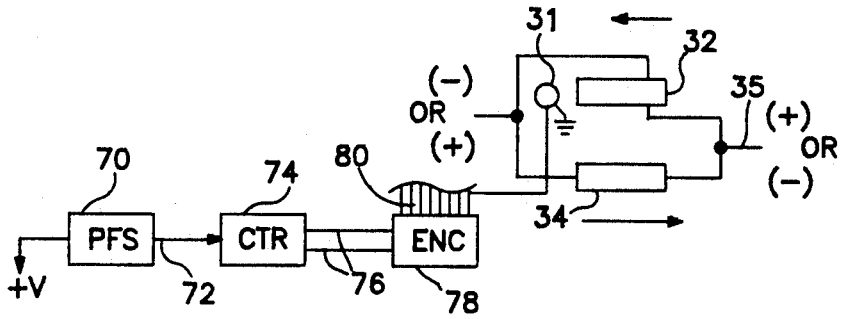
FIG. 18 is a schematic circuit diagram showing pin fall sensor control of current flow to a solenoid under light-responsive, indicia-displaying polarity and under reversed, indicia-blanking polarity.

FIG. 17 shows one means for utilizing a computer output to orient a set of Units 110 (likewise incorporating the Magnets 1) for selective display of any number (or character). The output of computers is generally a light-emitting display or may be converted to such by known, readily available means. Accordingly, a Light 31 may be associated with each unit or "Segment" 110 (seven segments being shown for display of any given numeric digit). An adjacent light-sensitive diode 32, say, may be used to detect activation of Light 31, thus providing an electric current selectively to a respective Coil 20 associated with each particular Segment 110 required for display of the desired digit in a seven-segment Display Device 108. As shown in FIG. 18, this occurs in response to operation of a Pin Fall Sensor (PFS Box 70) at the pit of a bowling lane. A pulse for each pin standing is supplied by PFS 70 on an Output Line 72 to a Down Counter 74. This last has an output on just one of ten Lines 76 connected to an Encoder (ENC) Box 78, which may be a known diode matrix, or equivalent. The one of the Lines 76 selected for output is determined by the count remaining in Down Counter 74 after the series of pulses from Box 70 and thus represents the pin down count. Box 78 converts the output on the one line 76 into an energizing signal on the Input Lines 80 of two to seven (generally five) of the Lights 31 in FIG. 17 for controlling the display status of the Segments 110 in accordance with the digit desired. As an example, upon detection of three pins standing, three pulses are sent on Line 72 to Down Counter 74 which then selects the seventh of the ten Lines 76 (equivalent to the "7" lead 1374 in FIG. 41 of applicant's prior U.S. Pat. No. 30,471) for a high output to Encoder Box 78. The resultant conversion places a high output on the first, fifth and seventh Input Lines 80 to Lights 31-1, 31-5 and 31-7, turning these ON to activate the related Coils 20-1, 20-5 and 20-7. Consequently, the corresponding Segments 110 are rotated in the manner described above to display the digit "7". Note that while the foregoing describes an automated system, Segments 110 may be controlled manually in a known fashion by input of pin-down information through a keyboard.

The potential may be positive or negative as determined by light or dark state of respective Lights 31 to orient the Magnets 1 in the display Alternatively, the light or dark state may set the segments of the display to the contrast condition, and clearance (neutral) accomplished by sweep of the entire Panel 100 (or a single character) by one or more Magnets 8 oriented to neutralize the display.

For purposes of setting display of a series of digits in Frames 103 of Panel 100 in FIG. 19, I prefer a single shiftable Assembly, generally indicated at 109 in FIG. 17. Assembly 109 comprises seven Coils 20-1 to 20-7 affixed to a movable carrier (not shown, but equivalent to any one of many known carriers in character-by-character printing units), the coils being arranged in a pattern and spacing consistent with the seven-segment display concept. The carrier is located behind Indicia Display Units 108 of Panel 100 and is moved in successive steps of one digit (or more) at a time, as required. Each coil 20 is energized by the respective Light 31 and light-sensitive Diode 32 under control of the above-described pin fall count indication (see also FIGS. 39-41 and related text of the cited reference) or equivalent. The plain Diode 34 (FIG. 17) conducts direct current in the appropriate direction to effect restoration to a blank display when reverse potential is applied. A double pole, double throw Switch 36 is provided for reversing the polarity of Lines 35 and 37 to effect that restoration (see FIG. 17*a*).

A Switch 38 is provided to apply current momentarily at each shifted position of Assembly 109 to control seven-segment display of information supplied from a bowling pit. Thus, a single Assembly 109 may be shifted from one to a plurality of ordinal display locations (108) to control information output on a complete multiorder display Panel 100 of the type shown in FIG. 19.

I have shown that there is more than one way of stabilizing the display magnets. A first way is the use of pivoted magnet pairs in which the pivot axes of the display magnets and those of the respective toggling magnets are mutually perpendicular (less precise results being obtained if these axes are parallel). Another way that stabilization of display magnets may be attained is the use of soft metal shunts, the results depending on the relative cross-sectional area, length, width and placement of the shunt and on the strength of the magnet. Strength of the preferred magnets depends on the ferrite material used, the fabrication process, etc. and therefore selection of size and shape depends on the result desired. Many types of commercially-available permanent magnets other than those specified may nevertheless be used for my display system.

From the foregoing description it will be seen that a plurality of configurations of control and display magnets exist in which the control magnets can exercise a rotative force upon a display magnet to present desired indicia (digits) in selected colors and/or textures as the output of a display. As of the filing date of this application, I believe the configuration of FIG. 15 to be the best mode for displaying single-digit pin fall information On line 101*a* at each Frame 103 in FIG. 19, whereas I believe the configuration shown at A in FIG. 16 to be the best mode for presenting multi-digit displays such as the three-digit cumulative scores on Line 101*b* at each Frame 103.

While the plurality of configurations described produce the desired effects, it will be clear to those skilled in the art that many changes to the described embodiments could be made without departing from the spirit and scope of the invention. For example, if control Magnet 3 in FIG. 2F were oscillated about a vertical axis located at the middle of Magnet 3 and intercepting the axis of Magnet 1 at an intermediate point midway along Magnet 1, a step of 180° would cause face W in FIG. 2F to be replaced by the face E as a result of the rotative forces on Magnet 1 (compare FIG. 2H). Furthermore, if Magnet 3 were turned over a full revolution in either direction in steps of 90°, then all four faces of Display Unit 10 could be presented in sequence or selectively and in entirely reversible fashion. As another example, Assembly 109 could hold sufficient Coils 20 thereon for parallel output of a plurality of digits (e.g., three digits per frame as in Line 101*b* of FIG. 19).

I claim:

1. An indicia display device comprising a support panel, a display unit having at least two modes of display and pivots supporting the unit on the panel for rotation about the pivot axis, and magnetic control means for rotating the unit from a first to a second mode of display, the control means comprising a first magnet fixedly supported in the display unit; in combination with a second magnet having first and second polar faces and further having a perpendicular axis of rotation relative to said pivot axis, one end of said second magnet being offset from said pivot axis and singly presenting said first polar face adjacent a first end of said first magnet when said unit is in said first mode, and energizable electromagnetic means for changing the field of flux of the second magnet from a first to a second condition, energizing of said electromagnetic means concommitantly rotating said second magnet through a predetermined angle about said perpendicular axis to bring said one end of the second magnet to a point singly presenting said second polar face adjacent the other end of said first magnet, said one end following a path substantially aligned with said pivot axis; and said display unit being rotated to said second mode of display in response to changing the field of flux to said second condition.

2. An indicia display device as defined in claim 1 in which said electromagnet is energized under control of a bowling pin fall signal.

3. An indicia display device comprising a support panel, a display unit having at least two modes of display and pivots supporting the unit on the panel for rotation about the pivot axis, and magnetic control means for rotating the unit from a first to a second mode of display, the control means comprising a first magnet fixedly supported in the display unit; in combination with a second magnet having an axis offset from and perpendicular relative to said pivot axis, one end of said second magnet being offset from said pivot axis and adjacent a first end of said first magnet when said unit is in said first mode, and a movable third magnet for changing the field of flux of the second magnet from a first to a second condition, a rocking movement of said movable third magnet through a predetermined angle concommitantly causing said one end of the second magnet to rotate to a point adjacent the other end of said first magnet and along a predetermined arcuate path substantially aligned with said pivot axis; and said display unit being rotated to said second mode of display in response to changing the field of flux to said second condition.

4. An indicia display device as defined in claim 3 in which said third magnet is an electromagnet.

5. An indicia display device as defined in claim 3 in which said third magnet is rotatably supported proximate said second magnet for rotation about a discrete perpendicular axis offset further relative to said pivot axis.

6. An indicia display device as defined in claim 5 in which said discrete perpendicular axis is at right angles to said perpendicular axis of the second magnet and parallel to said pivot axis.

7. An indicia display device as defined in claim 3, further comprising an electromagnet having a control armature therein, a lever mounted at one end of said electromagnet for rocking movement relative to said armature, pivot means supporting said third magnet on said lever at the opposite end thereof for pivotal movement from a first position of given polarity relative tot he armature to a second position having reversed polarity relative to the armature, means for energizing said electromagnet to produce opposite polarity of the armature, energizing of said electromagnet causing simultaneous, oppositely-directed respective rocking movement of said third magnet and said lever to thereby move the third magnet from said first position to said second position relative to the armature, with resultant successive rotation of the second and first magnets.

* * * * *

UNITED STATES PATENT AND TRADEMARK OFFICE

CERTIFICATE OF CORRECTION

PATENT NO. : 5,208,589

DATED : May 4, 1993

INVENTOR(S) : Eugene E. Reynolds

It is certified that error appears in the above-indentified patent and that said Letters Patent is hereby corrected as shown below:

Col. 4, line 51, "shown North" should be --shown. North--; Col. 7, line 27, "least 21" should be --lead 21--; Col. 13, line 30, "display Alternatively" should be --display. Alternatively--; Col. 14, line 21, "On line" should be --on line--, and the last "1" (terminal character) should be --I--; while in Claim 7 at lines 18/19 of Col. 16, "tot he" should be --to the--.

Signed and Sealed this

Third Day of May, 1994

*Attest:*

*Attesting Officer*

BRUCE LEHMAN

*Commissioner of Patents and Trademarks*